US008492991B2

(12) United States Patent
Lam et al.

(10) Patent No.: US 8,492,991 B2
(45) Date of Patent: Jul. 23, 2013

(54) LIGHTING FIXTURE SYSTEM FOR ILLUMINATION USING COLD CATHODE FLUORESCENT LAMPS

(75) Inventors: Victor Lam, Shatin (HK); Shichao Ge, San Jose, CA (US)

(73) Assignee: TBT Asset Management International Limited, Tortola (VG)

( * ) Notice: Subject to any disclaimer, the term of this patent is extended or adjusted under 35 U.S.C. 154(b) by 161 days.

(21) Appl. No.: 12/741,002

(22) Filed: Aug. 23, 2010

(65) Prior Publication Data

US 2010/0320929 A1 Dec. 23, 2010

(51) Int. Cl.
*H05B 41/24* (2006.01)

(52) U.S. Cl.
USPC ..... 315/277; 315/276

(58) Field of Classification Search
None
See application file for complete search history.

(56) References Cited

U.S. PATENT DOCUMENTS

| | | | |
|---|---|---|---|
| 1,870,147 | A | 8/1932 | Smally |
| 2,501,375 | A | 3/1950 | Breadner et al. |
| 3,253,176 | A | 5/1966 | Pate et al. |
| 3,660,839 | A | 5/1972 | Wittman |
| 3,812,393 | A | 5/1974 | Koo et al. |
| 4,017,758 | A | 4/1977 | Almer |
| 4,137,483 | A | 1/1979 | Ochi |
| 4,161,020 | A | 7/1979 | Miller |
| 4,300,073 | A | 11/1981 | Skwirut et al. |
| 4,871,944 | A | 10/1989 | Skwirut et al. |
| 5,497,048 | A | 3/1996 | Burd |
| 5,561,539 | A | 10/1996 | Funahata et al. |
| 5,702,179 | A | 12/1997 | Sidwell et al. |
| 5,751,104 | A | 5/1998 | Soules et al. |
| 5,775,801 | A | 7/1998 | Shaffer |
| 6,011,354 | A | 1/2000 | Tsai et al. |
| 6,050,704 | A | 4/2000 | Park |
| 6,053,623 | A | 4/2000 | Jones et al. |
| 6,054,806 | A | 4/2000 | Holzer |
| 6,064,155 | A | 5/2000 | Maya et al. |
| 6,109,757 | A | 8/2000 | Stephens |
| 6,144,170 | A | 11/2000 | Beland et al. |
| 6,211,612 | B1 | 4/2001 | Ge |
| 6,316,872 | B1 | 11/2001 | Ge et al. |
| 6,515,433 | B1 | 2/2003 | Ge et al. |
| 6,633,128 | B2 | 10/2003 | Hyes et al. |
| 6,672,733 | B2 | 1/2004 | Nagatani |
| 6,674,250 | B2 | 1/2004 | Cho et al. |
| 6,762,559 | B1 | 7/2004 | Ishikawa et al. |
| 6,765,633 | B2 | 7/2004 | Eom |
| 6,793,370 | B2 | 9/2004 | Moon et al. |

(Continued)

FOREIGN PATENT DOCUMENTS

| | | |
|---|---|---|
| CN | 1168117 C | 9/2004 |
| CN | 1725430 | 1/2006 |

(Continued)

OTHER PUBLICATIONS

USPTO, "Office Action" mailed on Jul. 9, 2010 in related U.S. Appl. No. 11/422,320, 18 pages.

(Continued)

*Primary Examiner* — Crystal L Hammond

(57) ABSTRACT

A lighting system for illuminating a chamber in a building includes a lighting fixture suitable for being mounted onto a surface of the chamber, so that light emitted by at least one CCFL device mechanically supported by the fixture illuminates the chamber.

11 Claims, 9 Drawing Sheets

U.S. PATENT DOCUMENTS

| | | | | |
|---|---|---|---|---|
| 6,879,114 | B2 | 4/2005 | Jales et al. | |
| 6,949,890 | B2 | 9/2005 | Chou et al. | |
| 6,979,101 | B2 | 12/2005 | Sauska et al. | |
| 7,075,247 | B2 * | 7/2006 | Lyle et al. | 315/247 |
| 7,141,933 | B2 | 11/2006 | Ball | |
| 7,178,944 | B2 | 2/2007 | Walton | |
| 7,182,501 | B2 | 2/2007 | Jang et al. | |
| 7,198,389 | B1 | 4/2007 | Kwong et al. | |
| 7,205,712 | B2 | 4/2007 | Yan | |
| 7,258,475 | B2 | 8/2007 | Kurumatani | |
| 7,309,964 | B2 | 12/2007 | Wey et al. | |
| 7,314,288 | B2 | 1/2008 | Wakabayashi | |
| 7,357,528 | B2 | 4/2008 | Marsh | |
| 2002/0163529 | A1 | 11/2002 | Evanicky | |
| 2003/0015957 | A1 | 1/2003 | Ge et al. | |
| 2003/0179577 | A1 | 9/2003 | Marsh | |
| 2003/0201967 | A1 | 10/2003 | Yu | |
| 2003/0223230 | A1 | 12/2003 | Li | |
| 2004/0095791 | A1 | 5/2004 | Huang et al. | |
| 2004/0129894 | A1 | 7/2004 | Coulombe et al. | |
| 2004/0130252 | A1 | 7/2004 | Ge | |
| 2004/0184269 | A1 | 9/2004 | Walton | |
| 2004/0240202 | A1 | 12/2004 | Sauska | |
| 2004/0257793 | A1 | 12/2004 | Wakabayashi | |
| 2005/0036315 | A1 | 2/2005 | Marsh | |
| 2005/0104522 | A1 | 5/2005 | Yabuki et al. | |
| 2005/0141151 | A1 | 6/2005 | Azodi | |
| 2005/0162089 | A1 | 7/2005 | Iida et al. | |
| 2005/0174769 | A1 | 8/2005 | Yong et al. | |
| 2005/0184684 | A1 | 8/2005 | Matsushima et al. | |
| 2005/0218808 | A1 | 10/2005 | Hsu et al. | |
| 2005/0219647 | A1 | 10/2005 | Lee et al. | |
| 2005/0265023 | A1 | 12/2005 | Scholl | |
| 2005/0265025 | A1 | 12/2005 | Jang et al. | |
| 2005/0275351 | A1 | 12/2005 | Ge | |
| 2005/0285476 | A1 | 12/2005 | Chou et al. | |
| 2006/0023470 | A1 | 2/2006 | Chen et al. | |
| 2006/0028921 | A1 | 2/2006 | Wang et al. | |
| 2006/0072311 | A1 | 4/2006 | Tseng et al. | |
| 2006/0245213 | A1 | 11/2006 | Beil et al. | |
| 2006/0256244 | A1 | 11/2006 | Jak | |
| 2006/0273731 | A1 | 12/2006 | Ge | |
| 2007/0041182 | A1 * | 2/2007 | Ge et al. | 362/184 |
| 2007/0103089 | A1 | 5/2007 | Fregoso et al. | |
| 2008/0049434 | A1 * | 2/2008 | Marsh | 362/377 |

FOREIGN PATENT DOCUMENTS

| | | | |
|---|---|---|---|
| DE | 195 48 325 | | 6/1997 |
| EP | 1 263 020 | | 12/2002 |
| FR | 837 795 | A | 2/1939 |
| GB | 984667 | | 3/1965 |
| JP | 01 173537 | | 7/1988 |
| JP | 02301959 | | 12/1990 |
| JP | 05 108776 | | 4/1993 |
| JP | 05 347084 | | 12/1993 |
| JP | 06 059590 | | 3/1994 |
| JP | 07 01453 | | 1/1995 |
| JP | 10 189259 | | 5/1995 |
| JP | 10012029 | | 1/1998 |
| WO | WO 01/20642 | | 3/2001 |
| WO | WO 01/94842 | A1 | 12/2001 |
| WO | WO 03/083896 | | 10/2003 |
| WO | WO 2005/078763 | A2 | 4/2005 |
| WO | WO 2005/078763 | A3 | 8/2005 |
| WO | WO 2007/012087 | A2 | 1/2007 |
| WO | WO 2007/012087 | A3 | 5/2007 |

OTHER PUBLICATIONS

USPTO, "Office Action" mailed on Jul. 9, 2010 in related U.S. Appl. No. 11/934,605, 47 pages.

R. Y. Pai, "Efficiency Limits for Fluorescent Lamps and Application to LCD Backlighting", Journal of the SID, May 4, 1997, pp. 371-374.

L. E. Tannas, Jr., "Flat Panel Displays and CRTs", Von Nostrand Reinhold, New York, 1985, pp. 339.

"Compact Fluorescent Lamp", Wikipedia, http://en.wikipedia.org/wiki/Compact_fluorescent_lamp, Dec. 19, 2007, pp. 1-19.

"FAQ's: Compact Fluorescent: GE Commercial Lighting Products", http://www.gelighting.com/na/business_lighting/faqs/cfl.htm; Dec. 19, 2007, pp. 1-5.

Samuel M. Goldwasser and Donald L. Klipstein "Compact Fluorescent Lamps" http://members.misty.com/don/cf.html, Dec. 19, 2007, pp. 1-3.

H. Noguchi, "A 50,000-hour Lifetime Cold-Cathode Fluorescent Lamp for LCD Backlighting," Harrison Electric Co., Ltd, Ehime, Japan, SID 99 Digest, 1999, pp. 908-911.

USPTO, "Office Action", mailed in related U.S. Appl. No. 11/055,536 on Sep. 26, 2007, 23 pgs.

USPTO, "Office Action," mailed in related U.S. Appl. No. 11/458,924 on May 15, 2008, 41 pgs.

USPTO, "Office Action," mailed in related U.S. Appl. No. 11/055,536 on May 30, 2008, 49 pgs.

USPTO, "Office Action," mailed in related U.S. Appl. No. 11/055,536 on Oct. 8, 2008, 40 pgs.

USPTO, "Office Action," mailed in related U.S. Appl. No. 11/458,924 on Dec. 8, 2008, 31 pgs.

USPTO, "Office Action", mailed in related U.S. Appl. No. 11/422,320 on Apr. 7, 2009, 20 pgs.

PCT, "Notification of Transmittal of the ISR and Written Opinion of the ISA," mailed Apr. 21, 2009, in related International Application No. PCT/US2008/082145, 10 pages.

USPTO "Final Office Action" mailed in related U.S. Appl. No. 11/055,536 on May 12, 2009, 27 pgs.

USPTO, "Office Action," mailed in related U.S. Appl. No. 11/458,924 on Sep. 18, 2009, 38 pgs.

USPTO "Office Action" mailed in related U.S. Appl. No. 11/055,536 on Oct. 5, 2009, 50 pgs.

USPTO "Office Action" mailed in related U.S. Appl. No. 11/934,605 on Nov. 13, 2009, 45 pgs,.

USPTO "Office Action" mailed in related U.S. Appl. No. 11,458,924 on Apr. 16, 2010, 31 pgs.

USPTO "Office Action" mailed in related U.S. Appl. No. 11/055,536 on May 14, 2010, 45 pgs.

Supplemental European Search Report for Application No. EP 08844438.5 dated Jul. 1, 2011, 11 pages.

Listing of Claims for European Application No. EP 08844438.5 filed Oct. 31, 2008, 4 pages.

Rejection Decision for Chinese Application No. 200680030348.0 dated Aug. 25, 2011, 5 pages.

Listing of Claims for Chinese Application No. 200680030348.0 filed Jul. 20, 2006, 5 pages.

USPTO, "Final Office Action" mailed Dec. 27, 2010, in U.S. Appl. No. 11/422,320, 20 pages.

* cited by examiner

FIG. 1A
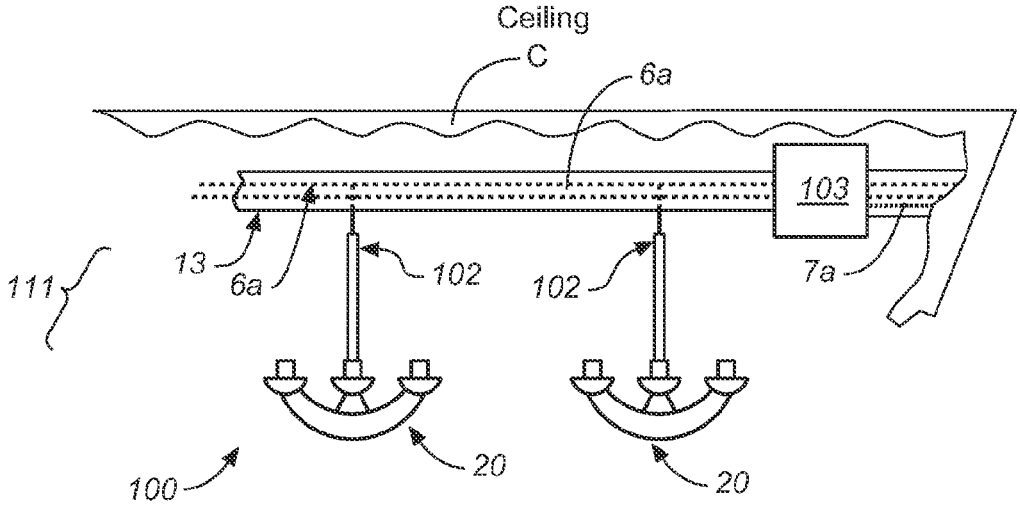
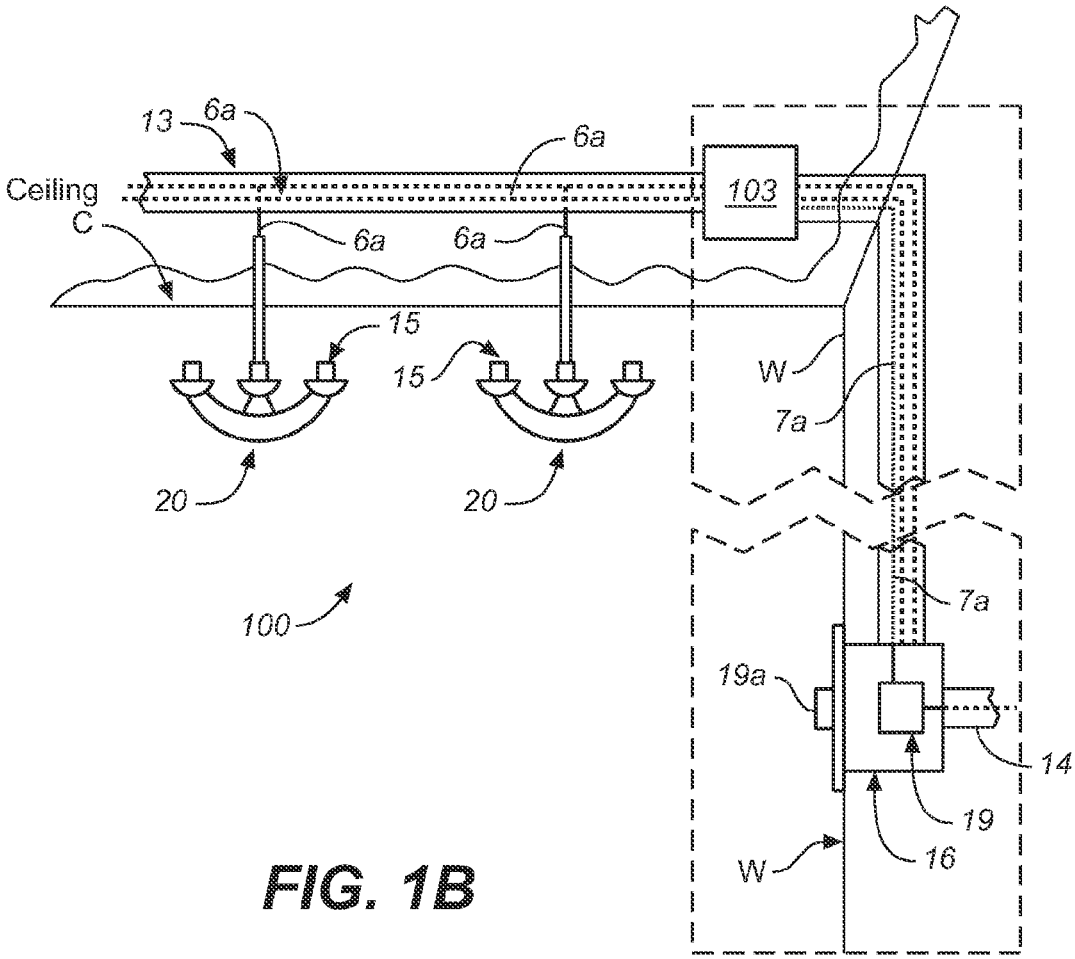
FIG. 1B

FIG. 5A
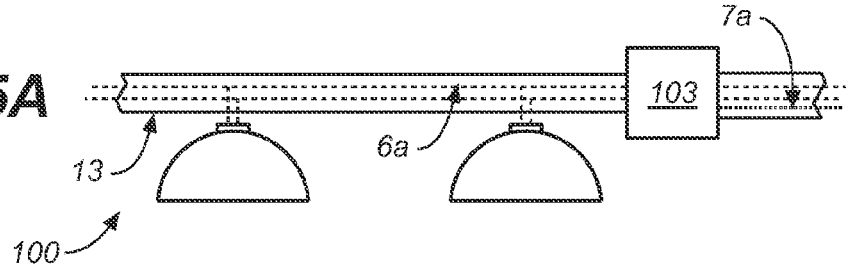
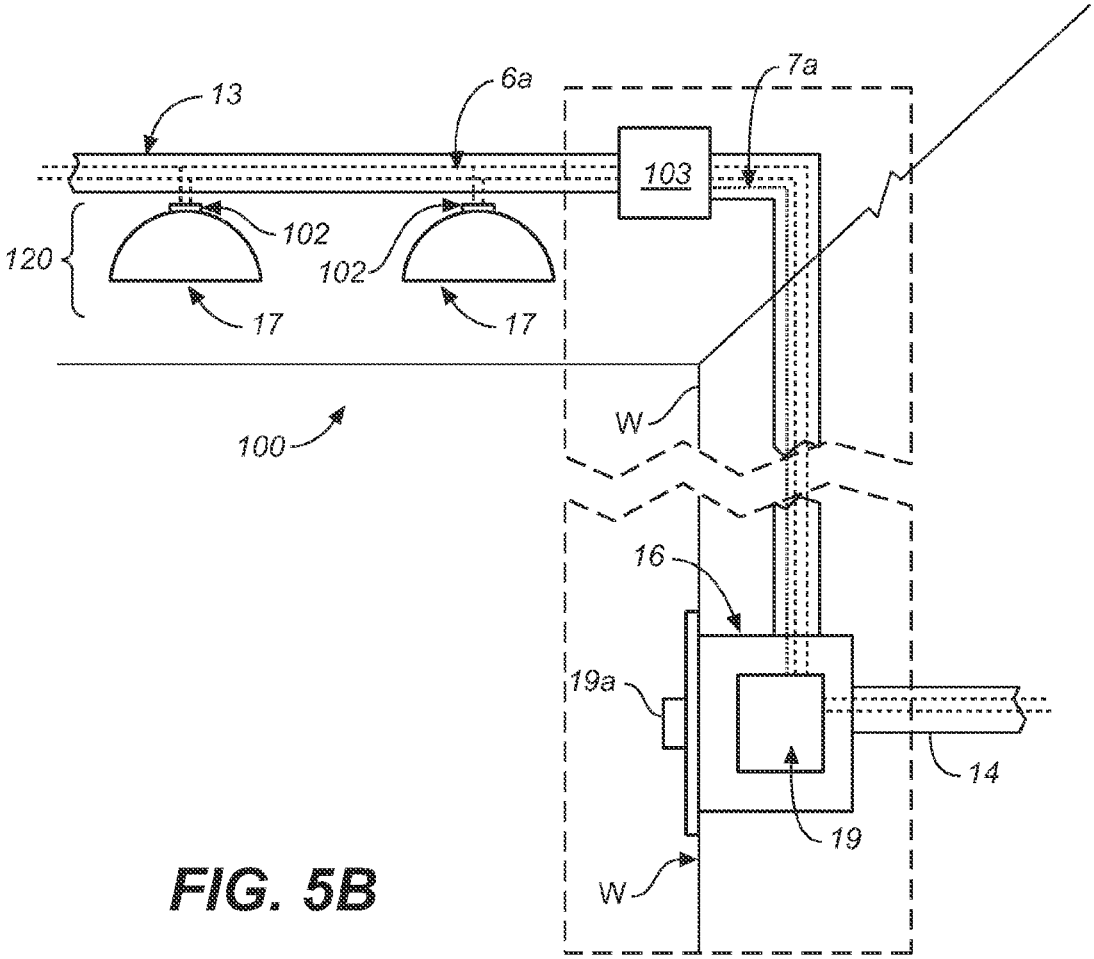
FIG. 5B

LIGHTING FIXTURE SYSTEM FOR ILLUMINATION USING COLD CATHODE FLUORESCENT LAMPS

CROSS-REFERENCE TO RELATED APPLICATIONS

The present application is a national phase application of PCT application no. PCT/US2008/082145 filed on Oct. 31, 2008, which claims the benefit of U.S. patent application Ser. No. 11/934,605, filed on Nov. 2, 2007, the contents of which are hereby incorporated by reference.

BACKGROUND OF THE INVENTION

This invention relates in general to gas discharge fluorescent devices, and in particular to a cold cathode fluorescent lamp (CCFL) system that is particularly versatile and useful for illumination applications, such as for illuminating a chamber in a building.

CCFL illumination systems are advantageous over hot cathode fluorescent lamps (HCFL) for many reasons and operates using mechanisms that are different from HCFL. The differences between CCFL systems and HCFL systems are explained in more detail in United States Patent Application Publication U.S. 2005/0275351 which is incorporated herein by reference.

As the world enters a period where energy costs will continually increase for the foreseeable future it is imperative to reduce the amount of energy that is consumed by lighting. As known to those skilled in the art, incandescent lighting is notoriously inefficient for lighting purposes. While HCFLs have been widely used to replace incandescent lamps for lighting purposes, the HCFLs are not as flexible as compared to CCFL lighting systems. For example, it may be difficult or impossible to adjust the intensity of light emitted by HCFL lighting systems for different lighting requirements, such as in a dimming operation. It is therefore desirable to provide an improved lighting systems, such as ones using CCFLs, which have better characteristics and flexibility compared to prior lighting systems.

One of the problems encountered in CCFL lighting systems is the fact that heat sensitive electronic components in the CCFL lighting system can be adversely affected by the heat generated by the CCFL lighting element itself and the lifetime of these electronic components may be reduced, thereby also reducing the useful life of the CCFL lighting system. Another problem encountered when CCFLs are used for general lighting is the need to include a converter for converting power from utility power line. This renders the CCFL device bulky and hard to use for lighting purposes, such as in lighting fixtures. It is therefore desirable to provide an improved CCFL lighting system where the above-described disadvantages are avoided or alleviated.

With the different roles lighting is playing in every day life, it is desirable to be able to adjust the intensity and color temperature of lighting applications. However, as noted above, it is difficult to use lamps such as HCFLs for lighting that uses dimming or adjustment of color temperature. The lighting fixtures presently available are also not adapted for lighting operations that permit the changing of color temperature. It is thus desirable to provide a lighting fixture that enables both dimming and the adjustment of color temperature, while also achieving high energy efficiency.

SUMMARY OF THE INVENTION

To alleviate one or more of the problems described above, in one embodiment of the invention, the electronics supplying power to the CCFL devices may be separated into two parts that are spaced apart, so that the heat generated by the CCFL devices do not substantially adversely affect the part of the electronics that is spaced apart from the devices. In this manner, the useful life of this part of the electronics is enhanced which may enhance the useful life of the lighting system. Separating the electronics into two parts also allows the portion of CCFL device that emits light to be reduced in size, which makes the CCFL system much more versatile for different applications.

According to one embodiment of the invention, a lighting system is used for illuminating a chamber in a building where the chamber has a number of surfaces. At least one lighting fixture supports at least one CCFL and at least one transformer when the lighting fixture is mounted onto one of the surfaces of the chamber. In this manner, light emitted by the at least one CCFL illuminates the chamber. A driver is capable of converting input power from a power source to an AC power having a voltage in the range of about 5 to 400 volts and at a frequency in the range of about 1 to 100 kilohertz. The driver is separated from the at least one CCFL device so that it is substantially unaffected adversely by heat generated by the at least one CCFL device. The at least one transformer is suitable for converting the AC power to an output power suitable for operating the at least one CCFL, causing the CCFL to emit light. In one implementation, in addition to the at least one transformer, one inductor and one capacitor are also included and are supported by the at least one lighting fixture.

With the above design, it is possible to physically separate the driver or controller from the at least one CCFL device, thereby reducing the adverse effects of heat generated by the at least one CCFL device on the driver and increasing the useful life of the CCFL lighting system. Since one driver can be used to supply power to more than one CCFL device, the cost of the CCFL lighting fixture system is also reduced.

Also, since it is possible for the bulk of the electronics (such as that in the driver or controller) to also be removed from the vicinity of the at least one CCFL device, the at least one CCFL device can be made into relatively smaller form factor, which will render the at least one CCFL device much more useful and versatile. In one implementation of this embodiment, the at least one CCFL device can be very similar in size to the conventional incandescent bulbs or conventional HCFL devices, and will fit nicely into the conventional lighting fixtures designed originally for incandescent bulbs or for conventional HCFL devices. In this manner, the conventional lighting fixtures need not be replaced; only the conventional incandescent bulbs or conventional HCFL devices are replaced by CCFL devices.

In another embodiment of the invention, a lighting system comprises a plurality of fixtures and a plurality of sets of CCFL devices, each set including at least two CCFL devices. Each set of CCFL devices is supported by a corresponding one of the plurality of fixtures. Each of the CCFL devices comprises at least one CCFL and at least one transformer, and preferably one inductor and/or one capacitor. The at least one transformer in each of the CCFL devices is suitable for converting AC power having a voltage in the range of 5 to 400 volts at a frequency in the range of about 1 to 100 kilohertz to an output power suitable for operating the at least one CCFL in such CCFL device. This causes the at least one CCFL to emit light. The lighting system further comprises a plurality of drivers each supplying voltages in the range of about 5-400 volts at frequencies in the range of about 1 kc-100 kc to a corresponding set of said plurality of sets of CCFL devices to cause said plurality of sets of CCFL devices to emit light. At least one of the plurality of drivers is connected by separate electrical connections to at least two CCFL devices in at least one of the plurality of sets of CCFL devices for supplying the same or different voltages to such at least two CCFL devices. The at least two CCFL devices in such one set comprises CCFLs with phosphors of different color temperatures, to provide adjustable color temperature lighting by such one set. This enables the lighting system to provide adjustable color temperature lighting.

One impediment in adopting a CCFL-based lighting system may be the need to replace existing wiring and lighting fixtures that are adapted for incandescent lamps or HCFLs. This concern can be alleviated by the following method in one embodiment by using CCFL devices having suitable connectors. This method may be applied to a lighting system designed for a configuration where one or more incandescent lamp or HCFL is supported by at least one lighting fixture mounted onto a surface of a chamber in a building where the at least one lighting fixture includes at least one conventional socket for an incandescent lamp or HCFL. The lighting system may also include electrical lines and a switch or controller controlling a voltage or current supplied to the at least one conventional socket through the electrical lines.

This method employs at least one CCFL device that may be electrically and mechanically connected to the at least one conventional socket in place of an incandescent lamp or HCFL where the at least one CCFL device comprises a connector that fits into the at least one conventional socket for electrically and mechanically connecting the at least one CCFL to the socket. The at least one CCFL device also comprises a transformer suitable for converting AC power having a voltage in the range of about 5 to 400 volts at a frequency in the range of about 1 to 100 kilohertz to an output power suitable for operating the CCFL, causing the at least one CCFL to emit light. This method comprises electrically and mechanically connecting to said at least one conventional socket the at least one CCFL device. At least one driver is installed in the lighting system where the driver is suitable for converting input power from a power source such as a utility power line to the AC power. The driver is then connected to the power source for converting input power from the power source to the AC power. In this manner, there is no need to alter the conventional lighting system, such as by replacing the electrical lines or the lighting fixture. In one implementation of this embodiment, the driver suitable for converting input power from a power source such as a utility power line to the AC power may be installed in the existing power junction box which is used to house the existing ON/OFF switch or dimmer of the existing lighting circuit with existing lighting fixtures.

Besides using the CCFL system to accommodate a conventional lighting fixture or lighting system as in the embodiments above, according to further embodiments, the CCFL system can also be used as a dedicated lighting fixture with build in CCFL devices. Where an entirely new lighting system is to be installed for example, such as in a new building, or during remodeling, there is no need to adapt the CCFL system to accommodate a conventional lighting fixture or lighting system. In such event, the lighting system includes at least one lighting fixture designed to mechanically support at least one CCFL and at least one transformer when the lighting fixture is mounted onto a surface of a chamber in a building. In this alternative embodiment, the lighting fixture is provided, and a driver is connected to a surface of the chamber and is caused to convert input power from a power source to AC power comprising a voltage in the range of about 5 to 400 volts at a frequency in the range of about 1 to 100 kilohertz. The driver is connected to the at least one transformer, which then converts the AC power to an output power suitable for operating the at least one CCFL, causing the CCFL to emit light for illuminating the chamber. In this case, it is no longer a CCFL device plugged into a conventional lighting fixture; preferably the CCFL device comes with the lighting fixture as a single unit, the CCFL device and the lighting fixture forming a unitary structure. This makes the lighting fixture systems using CCFL devices easy to install and use.

As an additional feature in the above method, the at least one lighting fixture may also be mounted onto a surface of the chamber in the building so that at least one lighting fixture mechanically supports the at least one CCFL and the at least one transformer.

In yet another alternative embodiment, where a plurality of fixtures are mounted onto a surface of a chamber in a building supporting a plurality of sets of CCFL devices, the CCFL devices may be used to emit light for lighting and illuminating the chamber. Each set of CCFL devices includes at least two CCFL devices each comprising CCFLs with phosphors of different color temperatures. Each of the sets of CCFL devices is supported by a corresponding fixture of a plurality of fixtures. Each of the CCFL devices comprises at least one CCFL and at least one transformer. In a method technique of such embodiment, input power from a power source is converted to AC power comprising one or more voltages in the range of about 5 to 400 volts at a frequency or frequencies in the range of about 1 to 100 kilohertz. The one or more voltages in the range of about 5 to 400 volts of the AC power are then supplied separately to at least two CCFL devices in one of the sets of CCFL devices, so that the same or different voltages are supplied to such CCFL devices. The at least one transformer in each of the at least two CCFL devices in such one set is suitable for converting the AC power supplied thereto to an output power suitable for operating CCFLs, causing the at least one CCFL in such CCFL device to emit light. Voltages supplied to the at least two CCFL devices in such one set are controlled separately and individually so that the same or different voltages may be applied to the at least two CCFL devices to provide adjustable color temperature lighting.

Yet another embodiment of the invention is directed to an apparatus suitable for use in altering a lighting system for illuminating a chamber in a building. The chamber has and is defined by a plurality of surfaces. The lighting system comprises at least one lighting fixture mounted onto one of the surfaces of the chamber in the building. The at least one lighting fixture includes at least one conventional socket for a conventional lamp. The lighting system further comprises electrical lines and a controller controlling a current supplied to the at least one conventional socket through said electrical lines. The apparatus comprises at least one CCFL device suitable for electrically and mechanically connecting to said at least one conventional socket, each of said at least one CCFL device comprising a CCFL lamp, a connector that fits into said at least one conventional socket for electrically and mechanically connecting said CCFL lamp to the socket, and a transformer suitable for converting an AC power having a voltage in the range of about 5-400 volts at a frequency in the range of about 1 kc-100 kc to an output power suitable for operating the CCFL lamp, causing the CCFL lamp to emit light to illuminate said chamber. The apparatus further comprises an adapter unit, the adapter unit comprising at least one driver suitable for converting input power from a power source to said AC power.

In yet another embodiment of the invention, a lighting fixture comprises at least two CCFL devices, each of the CCFL devices comprising at least one CCFL and at least one transformer. The at least one transformer in each of the CCFL devices is suitable for converting an AC power having a voltage in the range of about 5-400 volts at a frequency in the range of about 1 kc-100 kc to an output power suitable for operating said at least one CCFL in such CCFL device, causing the at least one CCFL to emit light. The lighting fixture comprises at least one driver supplying voltages in the range of about 5-400 volts at frequencies in the range of about 1 kc-100 kc to the at least two CCFL devices to cause said at least two CCFL devices to emit light. The at least one driver is connected by separate electrical connections to the at least two of the CCFL devices for supplying the same or different voltages to the at least two CCFL devices. The at least two CCFL devices comprises CCFLs with phosphors of different color temperatures, so that voltages applied by the at least one driver to the at least two CCFL devices will provide adjustable color temperature lighting. The lighting fixture also comprises a housing mechanically connected to and supporting the at least two CCFL devices and the at least one driver so that the at least one driver is spaced apart from the at least two CCFL devices, and so that the at least one driver is substantially unaffected adversely by heat generated by the at least two CCFL devices.

Still another embodiment of the invention is directed to a lighting system for illuminating a chamber in a building, said chamber having and defined by a plurality of surfaces, comprising the fixture of the type described in the paragraph immediately above, and a lighting controller controlling a voltage or current supplied to the at least one driver or controlling the at least one driver, or both.

One more embodiment of the invention is directed to a method for altering a lighting system for illuminating a chamber in a building, where the chamber has and is defined by a plurality of surfaces. The lighting system comprises at least one lighting fixture mounted onto one of the surfaces of the chamber in the building, electrical lines and a controller controlling a current supplied to the at least one lighting fixture through said electrical lines. The method comprises (a) replacing said at least one lighting fixture by at least one substitute lighting fixture, each of said at least one substitute lighting fixture is of the type described in the two paragraphs immediately above. The method further comprises (b) connecting the electrical lines to the at least one driver of the at least one substitute lighting fixture; and (c) replacing the controller by a substitute controller capable of sending signals to the at least one driver to control the voltages supplied to the at least two CCFL devices of the at least one substitute lighting fixture, to provide adjustable color temperature lighting.

All patents, patent applications, articles, books, specifications, other publications, documents and things referenced herein are hereby incorporated herein by this reference in their entirety for all purposes. To the extent of any inconsistency or conflict in the definition or use of a term between any of the incorporated publications, documents or things and the text of the present document, the definition or use of the term in the present document shall prevail.

BRIEF DESCRIPTION OF THE DRAWINGS

FIG. 1A illustrates a lighting system illuminating a chamber in a building useful for illustrating one embodiment of the invention.

FIG. 1B illustrates another portion of the lighting system of FIG. 1A to illustrate the embodiment of FIG. 1A.

FIG. 5A is a perspective view of a portion of a lighting system where an entirely new lighting system is being installed onto a surface of a chamber in a building to illustrate another embodiment of the invention.

FIG. 5B is a schematic view of another portion of the lighting system of FIG. 5A to illustrate the embodiment of FIG. 5A.

Identical components in this application are labeled by the same numerals.

DETAILED DESCRIPTION OF EXEMPLARY EMBODIMENTS

Figure 2:
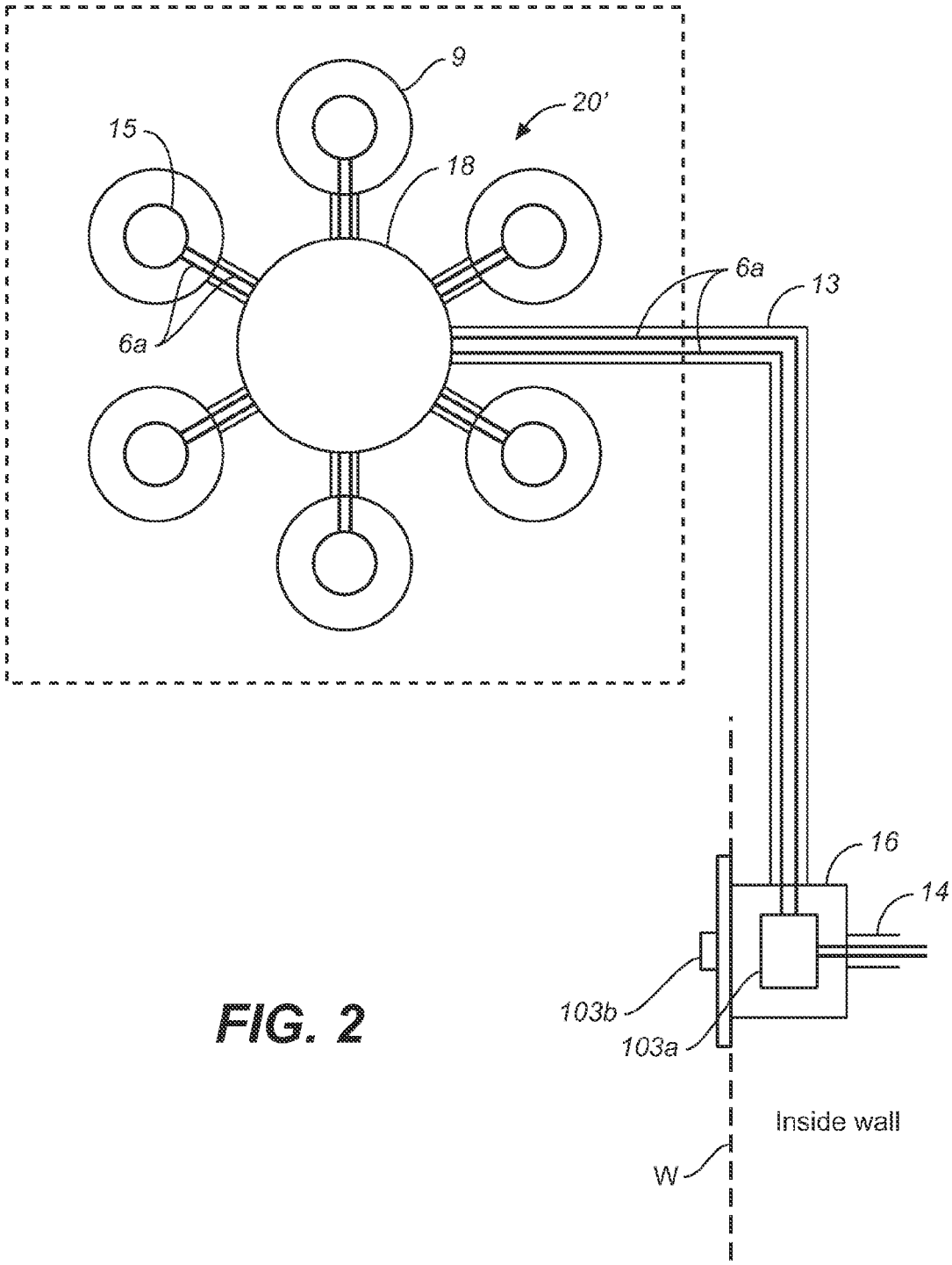
FIG. 2 illustrates a lighting system employing a conventional lighting fixture with multiple conventional lamp sockets each connected to a CCFL lamp to illustrate an alternative embodiment to the one of FIG. 1, and illustrates how a lighting system designed for use with incandescent lamps may be converted into one using CCFLs.

FIG. 1A illustrates a lighting system illuminating a chamber in a building useful for illustrating one embodiment of the invention. As shown in FIG. 1A, a plurality of lighting fixtures 20 are mounted and hung from the ceiling C of a chamber 100 of a building by a conventional means such as screws or rivets or eyelets 102 (not shown in detail). Most of the ceiling C (including the portions to which rivets or eyelets 102 are attached) in FIG. 1A has been cut away to expose the electrical conduits 13 above the ceiling C and the connections between the fixtures 20 and the conduit. A building is any man-made structure used or intended for supporting or sheltering any use or continuous (human) occupancy. A lighting fixture is an electrical device used to create artificial light or illumination in a building. While four fixtures are shown in FIG. 1A, it will be understood that fewer or more fixtures may be used, as illustrated in FIG. 2, which illustrates an alternative embodiment. Each fixture 20 may hold and support one or more CCFL devices 15. Power is conveyed to the CCFL devices 15 by power or electrical lines 6*a* in conduit 13 (e.g. one made of metal, and in some PVC or polyvinylchloride) from a controller 19. Preferably, controller 19 is placed into the conventional power junction box 16 shown in FIG. 1B behind wall W, which junction box is designed to hold and support a conventional ON/OFF lighting switch or lighting dimmer. Controller 19 has a user interface 19*a* such as buttons or knobs for adjusting the brightness and for turning the lighting on or off. Conduit 14 shown in FIG. 1B carries 110V/220V, 50 Hz/60 Hz AC power into the power junction box holding controller 19 and another conduit 13 brings wires 6*a* that will distribute power to the rest of the lighting circuit (e.g. CCFL devices 15) controlled by this power junction box. The junction box and its connecting conduits 13 and 14 are all hidden behind the wall W, or can be placed above the ceiling C and controlled remotely as described below. Portions of conduits 13 are hidden behind the ceiling C and wall W. The junction box is adapted to be mounted onto a chamber surface, by means such as screws. In other words, controller 19 is placed into junction box in place of or to replace a conventional ON/OFF lighting switch or lighting dimmer.

Controller 19 receives electric power, such as power at 50 or 60 Hz and 110 or 220 volts, from a power source such as utility power lines in conduit 14. Drivers 103, such as lighting ballasts, are installed in a circuit path of electrical lines 6*a* in conduits 13 above the ceiling C, for converting such electric power from controller 19 to an AC power (or AC signal, or AC power signal), having voltages in the range of about 5 to 400 volts at a frequency in the range of about 1 to 100 kilohertz. The load driven by the drivers 103 has a substantially constant electrical resistance, and the currents supplied by the drivers 103 also vary at frequencies in the range of about 1 to 100 kilohertz. This AC power is supplied by drivers 103 to the CCFL devices 15. Devices 15 each includes a transformer and a CCFL, where the transformer in each device 15 converts the AC power received to output power (or output signals, or output power signal) suitable for powering the CCFL, such as a voltage of 1,000 to 10,000 volts, and a voltage comprising voltage pulses at a frequency in the range of about 1 to 100 kilohertz. Drivers 103 preferably are each capable of converting power in a range of 100 Watts to 200 Watts. When controller 19 is used in commercial applications to control larger numbers of CCFL devices in each lighting circuit, it is preferably capable of converting power in a range of 100 W~2000 W, and controller 19 is preferably installed next to the lighting circuit behind the ceiling or wall. While multiple drivers 103 driving the CCFL devices are shown, it will be understood that a single driver 103 may suffice, depending on the power requirements of the fixtures 20, where the single or multiple drivers may be controlled by a single controller 19.

Drivers 103 are preferably connected to and supported by a surface (such as ceiling or wall) of chamber 100 so that they are physically separated and spaced apart from the CCFL devices 15 by a distance such that its operation and useful life are not affected by heat generated by the CCFL devices. In one embodiment, controller 19 is located not more than 1 foot from the CCFL devices, although a smaller distance may suffice, as in the embodiments of FIGS. 7A and 7B. In this manner the drivers 103 are not or less affected by heat generated by the devices 15. This increases the life time of the drivers 103. In contrast, conventional CCFL devices include drivers or controllers for converting power from utility power lines in the vicinity of the CCFLs, so that heat generated by the CCFLs adversely affects and reduces the useful life of the drivers or controllers and hence of the CCFL devices themselves. As shown in FIG. 1A, the drivers 103 are located physically separated by at least one foot from the CCFL devices 15 supported by fixtures 20.

Another advantage of the lighting system 110 illustrated in FIG. 1A is that a single controller 19 may be used to control the lighting from a number of CCFL devices, thereby reducing the cost of system 110. Furthermore, by designing the CCFL system such that drivers 103 are separate from the CCFL and the transformer, when the CCFL and transformer become defective or the controller become defective, only the defective part or parts need to be replaced, again reducing the cost of maintenance of system 110 compared with conventional CCFL systems. In addition, by locating a large part of the electronics for driving the CCFL apart from the CCFL device, it is possible to reduce the overall size of the CCFL device (which includes the CCFL and transformer) to a size suitable for replacing conventional light sources such as incandescent lamps or other smaller light sources. The wall-mounted controller 19 can control multiple drivers or ballasts 103 to provide manual control of ON/OFF/dimming of the lamps in one or more lighting circuits controlled by a single ballast 103 through embedded signals transmitted through lines 6*a* also used to carry power for lighting purposes, in a manner described below in reference to FIG. 8A. As described below in reference to FIG. 8A, each of the drivers or ballasts 103 includes a receiver and a microprocessor for receiving and deciphering the embedded signals. The ballast 103 can also be equipped with wireless receiver to receive wireless ON/OFF/dimming control signals (e.g. infrared or radio frequency signals) through wireless means, which can be a wall mounted intelligent ON/OFF/dimming controller 19 equipped with a wireless transmitter. It can also be controlled through a portable wireless device (not shown here).

Figure 3A:
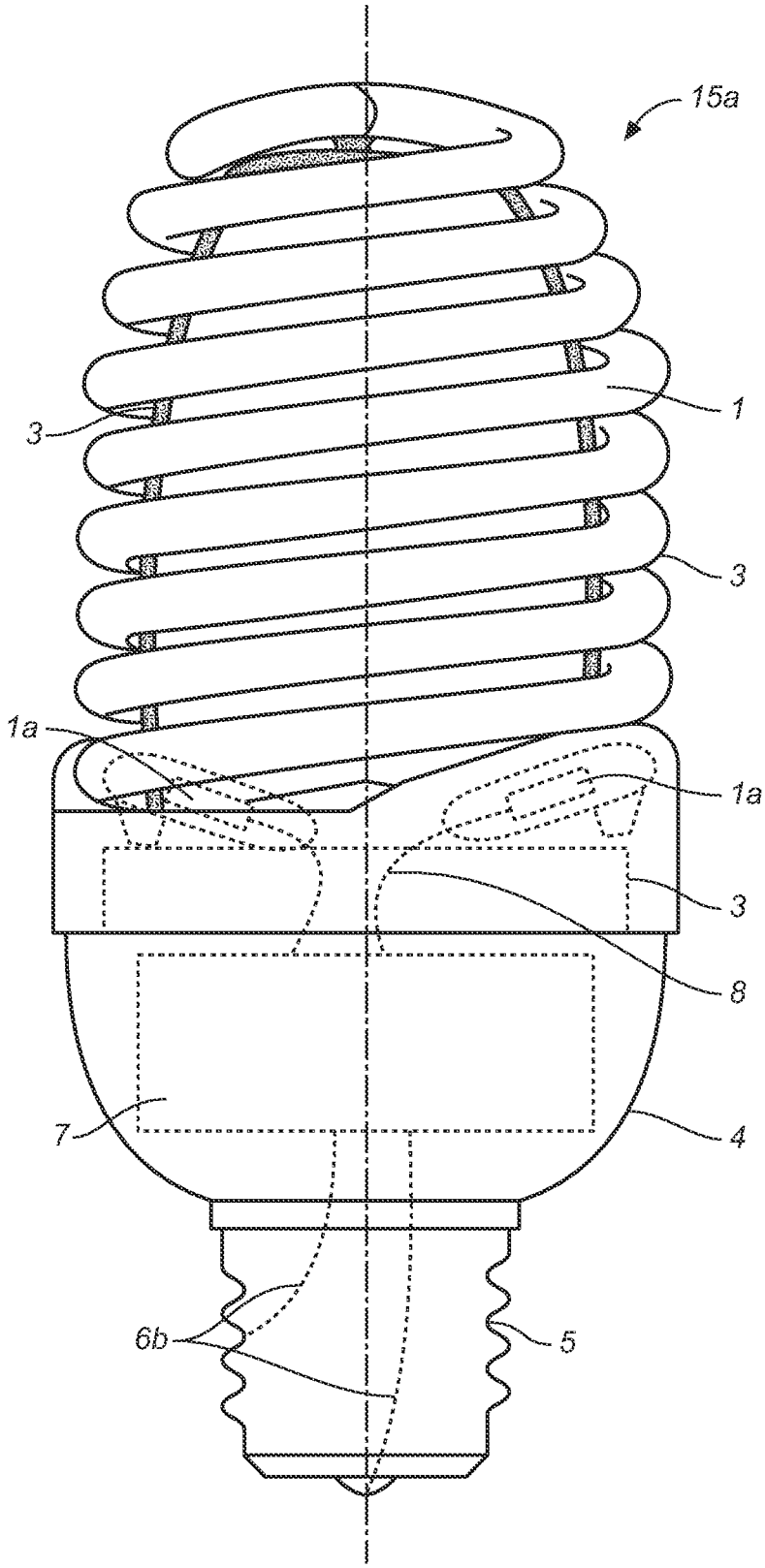
FIGS. 3A and 3B are perspective views of CCFL lamps with drivers and conventional lamp connectors that may be used to replace incandescent lamps to illustrate the embodiment of FIGS. 1A, 1B and 2.
Figure 3B:
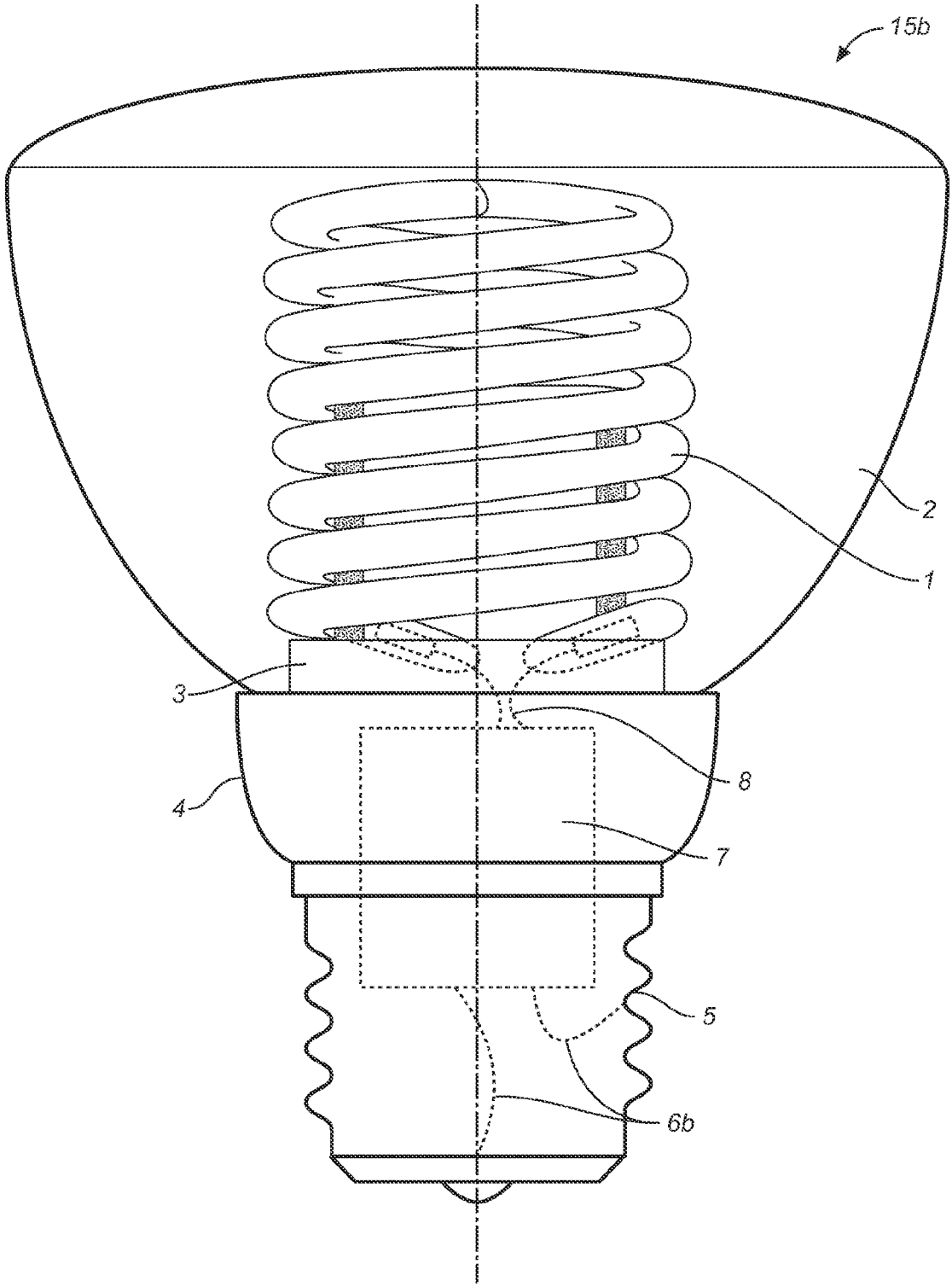

Yet another alternative to the embedded signal or wireless signal for control is to run extra wires 7*a* shown in FIG. 1A between controller 19 and drivers 103, to carry the control signal from controller 19 to drivers 103, for dimming operation.

Where the lighting fixtures 20 are ones with multiple conventional lamp sockets, it is possible to retro-fit such fixtures by replacing the incandescent or HCFL lamps in these sockets with CCFL lamps with the appropriate type of connectors, such as those illustrated in FIGS. 3A and 3B. Drivers 103 will need to be inserted into the circuit path of lines 6*a* as noted above. While it is possible to use the conventional dimming circuits designed for conventional fixtures, such as those using incandescent lamps, for controlling the dimming operation of CCFL devices, it is preferable to replace such conventional dimming circuits with other circuits instead. This is because conventional dimming circuits employ SCR type of dimming control to simply change the current passing through the incandescent lamp, which is a resistor. The CCFL device is not a resistive type of device. It is an active device with characteristics of capacitive loading. SCR type of dimmer is not a good fit for this kind of loading. Using microprocessor and digital control for CCFL dimming to control the drivers 103 specially designed to handling the capacitive loading of the CCFL device can bring out the best performances of the CCFL device to achieve smooth and linear dimming operations, similar to that achieved by changing resistance of a resistor for dimming control of incandescent lamps. Drivers or ballasts 103 and the associated circuit 7 in the CCFL described below, however, include capacitors and optional inductors. Conventional resistive dimming circuits would reduce the performance of the CCFL devices when used to operate lighting devices with significant capacitive or inductive loads. For this reason, it is preferable to replace the conventional ON/OFF switch or dimmer in box 16 with controller 19.

Controller 19 can include the conventional ON/OFF switch use to control ON/OFF power supply to driver 103 to cause it to perform ON/OFF function. However, controller 19 further includes an additional transmitter capable of sending out embedded control signals or RF signal to drivers 103. The embedded signal will be carried through by the two wires sending utility AC power to drivers 103. Control can also be wireless, where an RF signal is transmitted through RF transmitter in controller 19 wirelessly through radio frequency. It can also send a control signal through an added wire 7*a* directly to the driver 103. Since drivers 103 can be daisy chained together through their control port, controller 19 only needs to send such control signal through the additional wire 7*a* to one driver 103 to control multiple drivers 103 in the lighting system. In this manner, each of the drivers through its receiver and microprocessor can receive and decipher the information in the control signals to control the voltage applied to the individual CCFLs, so that intensity of light emitted by each individual CCFL can be controlled independently from all other CCFLs.

FIG. 2 illustrates a portion of a lighting system employing conventional lighting fixtures 20' with multiple conventional lamp sockets (not shown) for incandescent lamps each with its own lamp housing which has been adapted for use with CCFL lamps to illustrate an alternative embodiment to the one of FIG. 1A. FIG. 2 also illustrates another method as to how a lighting system designed for use with incandescent lamps may be converted into one using CCFLs. As shown in FIG. 2, electrical lines 6*a* in conduit 13 are connected to connectors (not shown) in a wiring compartment 18 of the conventional lighting fixture 20'. These connectors enable the AC power on lines 6*a* in conduit 13 to be connected to the six CCFL devices 15 supported by fixture 20' when the fixture is mounted to the ceiling (not shown) in the same manner as fixtures 20 are mounted to ceiling C as illustrated in FIG. 1A. The CCFL devices 15 are housed within portions 9 of the conventional lighting fixture 20'. Instead of a set of separate drivers 103 and controller 19 as in FIG. 1A, the functions of all such components may be combined in controller 103*a*, which performs the functions of drivers 103 as well as those of controller 19 of FIG. 1A. Controller 103*a* may be housed in a controller housing 16. As noted above, housing 16 located behind wall W can be the conventional power junction box used to house the conventional ON/OFF switch or dimmer for the conventional lighting fixture with multiple lamp sockets. Controller 103*a* has a user interface 103*b* such as buttons or knobs for adjusting the brightness and for turning the lighting on or off. The embodiment of FIG. 2 may be suitable for home applications where the lighting application does not require more than 100 W of power. In such event, a combined controller 103*a* will fit within a conventional junction box. This embodiment has the advantage that no driver needs to be inserted in the circuit path of wires 6*a*. All one has to do is to replace the incandescent lamps with CCFL lamps, and to replace the conventional ON/OFF switch or dimmer for the conventional lighting fixture with controller 103*a* with user interface 103*b* in the junction box 16.

Multiple fixtures similar to lighting fixtures 20' of FIG. 2 can be controlled by a single ballast 103 as shown in FIG. 1A. When the lighting system only consists of one lighting fixture with multiple lighting devices, a lighting arrangement such as 20' illustrated in FIG. 2 may be used. This can be a chandelier with six 40 W candle shaped incandescent bulbs, which can be replaced by six 9 W CCFL device 15. Each of the CCFL devices 15 consumes less than 15 W and the total energy consumption of this lighting fixture is less than 100 W.

Figure 3C:
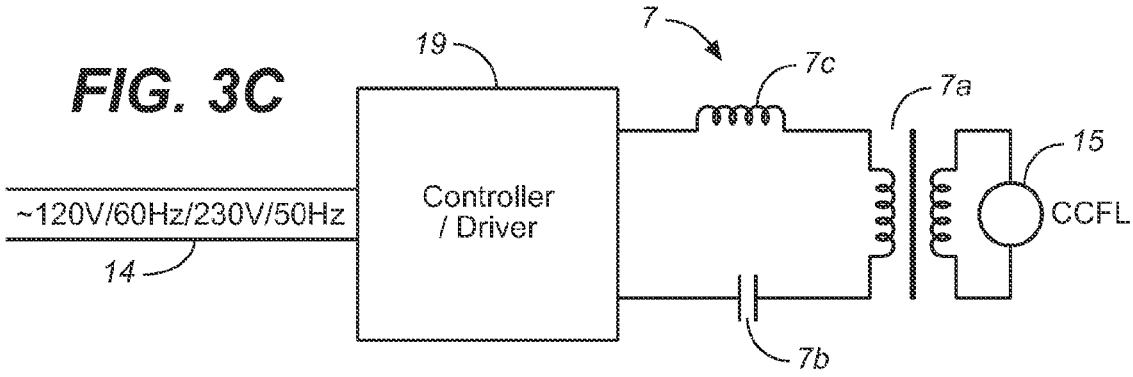
FIG. 3C is a schematic diagram of a circuit in the CCFL lamps of FIGS. 3A and 3B comprising a transformer, a capacitor and an inductor.

FIGS. 3A and 3B are perspective views of two different CCFL lamps with drivers and conventional lamp connectors that may be used to replace incandescent lamps to illustrate the embodiment of FIGS. 1A, 1B and 2. As shown in FIG. 3A, CCFL device 15*a* comprises CCFL 1 with electrodes 1*a*, lamp support 3, a connector 5 that fits into a conventional socket (not shown) for incandescent lamps to electrically and mechanically connect the CCFL device to the socket, a circuit 7 comprising a capacitor and a transformer (and optionally an inductor) capable for converting AC power having a voltage in the range of about 5 to 400 volts at a frequency in the range of about 1 to 100 kilohertz to an output power suitable for powering a CCFL. CCFL device 15*a* also includes wires 8 connecting the electrodes 1*a* at the two ends of the CCFL 1 to the circuit 7. Wires 6*b* connect the circuit 7 to connector 5 which may be electrically connected to wires 6*a* of FIG. 2 through the conventional socket. In this manner, the AC power from controller 19 is conveyed to the circuit 7. The transformer in circuit 7 converts this AC power to an output power suitable for powering a CCFL and supplies this output power to electrodes 1*a*, causing CCFL 1 to emit light. FIG. 3C is a schematic diagram of electronic circuits including driver 19 and circuit 7 in the CCFL lamps of FIGS. 3A and 3B comprising a transformer 7*a*, a capacitor 7*b* and an inductor 7*c*.

FIG. 3B illustrates another design 15*b* for CCFL device 15, where the device includes a lamp housing 2 not present in CCFL device 15*a*. With this exception CCFL device 15*b* is constructed and operates in a manner similar to device 15*a*. Housing 2 preferably comprises a metallic, plastic, ceramic or glass material that transmits light.

Figure 4:
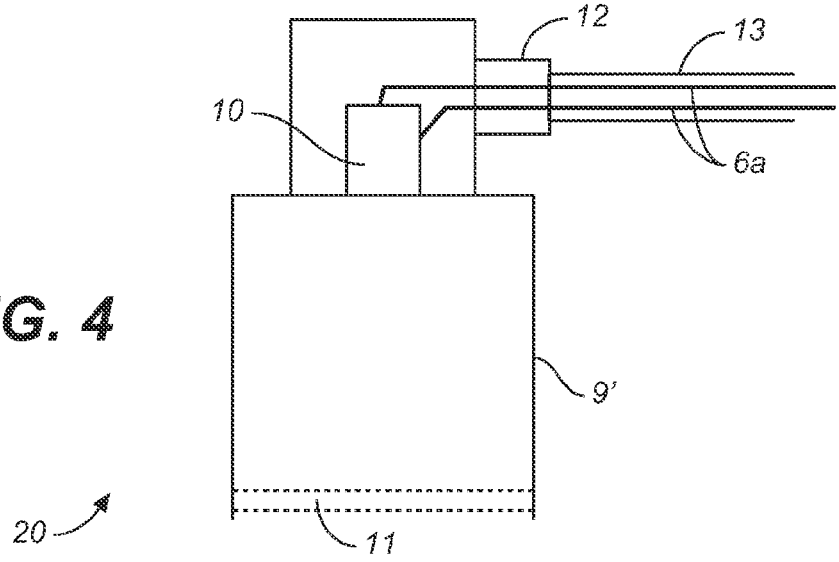
FIG. 4 is a schematic view of a conventional lighting fixture with a conventional lamp socket and connector, and two conduits connected to the fixture to form a lighting circuit, useful for illustrating embodiments of the invention, including those of FIGS. 1-3B.

FIG. 4 is a schematic view of a conventional lighting fixture with a conventional lamp socket and connector, and two conduits which is used to connect the fixture to form a lighting circuit, useful for illustrating embodiments of the invention, including those of FIGS. 1-3B.

The above described schemes for using CCFLs to replace incandescent lamps for use in conventional lighting fixtures work also for replacing HCFLs in conventional lighting fixtures. Thus, illustrated in FIG. 4 is a generalized scheme that can be used for replacing either incandescent lamps or HCFLs in conventional lighting fixtures. As shown in FIG. 4, fixture 20 includes a housing or housing portion 9', a socket 10 designed for mechanical and electrical connection to an incandescent lamp or a HCFL, a connector 12 for housing connection wires 6*a* in conduit 13 that convey AC power to the socket 10 from controller 19. An optional face plate 11 may also be included.

The systems illustrated by FIGS. 1-4 above may be arrived at by converting a conventional lighting system designed for use with incandescent lamps or HCFLs. Thus, the fixtures 20 and 20' may simply be ones originally designed for incandescent lamps or HCFLs. The sockets in these figures, such as socket 10 in FIG. 4, are originally designed for incandescent lamps or HCFLs. Instead of installing incandescent lamps or HCFLs in these sockets, CCFL devices such as those of FIGS. 3A and 3B (or CCFL devices with the form factors of HCFLs) may be installed instead. In addition, the switches for controlling the conventional lighting system using incandescent lamps or a HCFLs may be replaced by controller 103*a* (e.g. FIG. 2) that is capable of converting power from a power source, such as a utility power line, to an AC power having a voltage in the range of about 5-400 volts varying at a frequency in the range of about 1 kc-100 kc. Alternatively, one or more drivers or ballasts 103 and a controller 19 may be installed between the utility power source and conduit 13 connected to the CCFL devices as in FIGS. 1A and 1B.

Thus, the method for altering a conventional lighting system with a fixture mounted onto a surface of a chamber is very simple. It includes electrically and mechanically connecting a CCFL device to at least one conventional socket supported by the fixture, where the CCFL device comprises a CCFL, a connector that fits into said at least one conventional socket for electrically and mechanically connecting said CCFL to the socket, and a transformer suitable for converting an AC power having a voltage in the range of about 5-400 volts varying at a frequency in the range of about 1 kc-100 kc to an output power suitable for operating the CCFL lamp, causing the CCFL lamp to emit light. It includes installing or connecting a driver and a controller (or a combined driver/controller unit) between the CCFL lamp and a power source (e.g. utility power source), the driver being suitable for converting input power from the power source to said AC power. If a conventional switch is used to control the conventional lighting system, it will need to be either replaced by the driver and a controller, or a combined driver/controller unit.

New Lighting System

Where a lighting system is to be installed in a new building or in a remodeling process, or in a simple replacement of an old lighting system, the above designs and process may be further simplified. This is illustrated in FIGS. 5-6.

FIG. 5A is a perspective view of a portion of a lighting system comprising four fixtures 120 each containing a CCFL device 17 where an entirely new lighting system is being installed onto a surface of a chamber in a building to illustrate another embodiment of the invention. FIG. 5B is a schematic view of another portion of the lighting system of FIG. 5A to illustrate the embodiment of FIG. 5A. FIG. 6 is a schematic view of a lighting system with a built-in CCFL driver or controller comprising at least one transformer, and preferably an inductor and capacitor, but without a conventional lamp socket for housing an incandescent lamp or HCFL, to illustrate the embodiment of FIG. 5A. The CCFL 1, circuit 7, housing for circuit 7, support 3 and housing 9" are connected (preferably attached together) to form a single unit or unitary structure that can be easily installed, handled and replaced if necessary.

Figure 6:
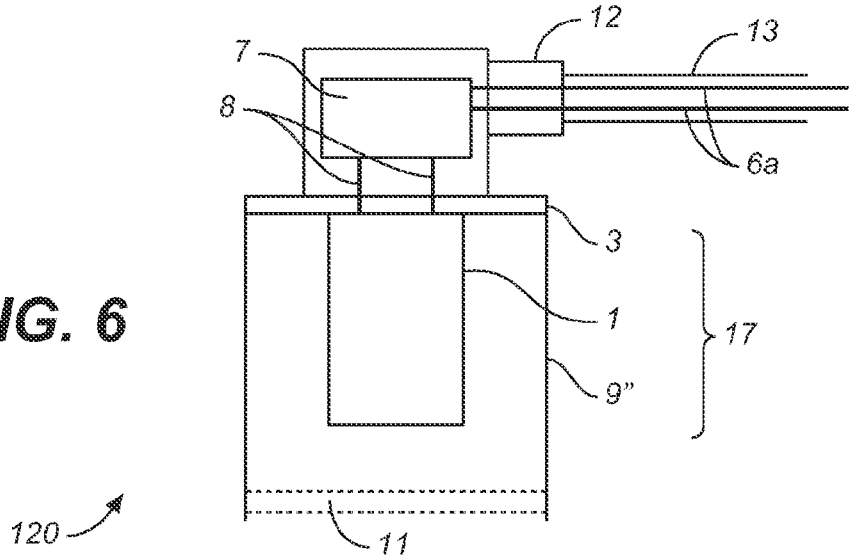
FIG. 6 is a schematic view of a lighting system with a built-in CCFL driver or ballast comprising at least one transformer and capacitor without a lamp socket to illustrate the embodiment of FIG. 5A.

The major difference between fixture 120 (holding CCFL device 17) of FIGS. 5A and 6 on one hand and fixture 20 or 20' in FIGS. 1, 2 and 4 on the other is that, unlike fixtures 20 and 20', fixture 120 does not include conventional sockets for the installation of incandescent lamps or HCFLs. Instead, in CCFL device 17, a CCFL 1 may be connected directly to wires 8 which connect the CCFL 1 to circuit 7. CCFL device 17 thus includes CCFL 1, wires 8 and circuit 7. In addition to a transformer, circuit 7 preferably includes an inductor and a capacitor suitable for converting the AC power from controller 19 into power suitable for operating CCFL 1, where the AC power comprises a voltage in the range of about 5-400 volts varying at a frequency in the range of about 1 kc-100 kc. Ceiling C has been omitted in FIG. 5A to simplify the figure and to expose the electrical conduits 13 above the ceiling C and the connections between the fixtures 120 and the conduit. Fixtures 120 are mounted and hung from the ceiling. While controller 19 is shown as installed behind wall W in FIGS. 1-6, again preferably in a junction box, it will be understood that it may be installed on the same surface of chamber 100 as fixtures 20 and 120, such as the ceiling (or wall W), if desired.

The drivers 103 in FIG. 5A can be controlled by control signals from controller 19 in the same manner as those described above in reference to FIGS. 1A, 1B, namely, through embedded signals on the AC power lines 6*a*, through control signals on extra wires 7*a*, or through wireless means. In this manner all of the CCFL devices 17 can be controlled in turning ON/OFF or dimming operations.

Lighting Systems with Adjustable Color and Multiple Colors

Figure 7A:
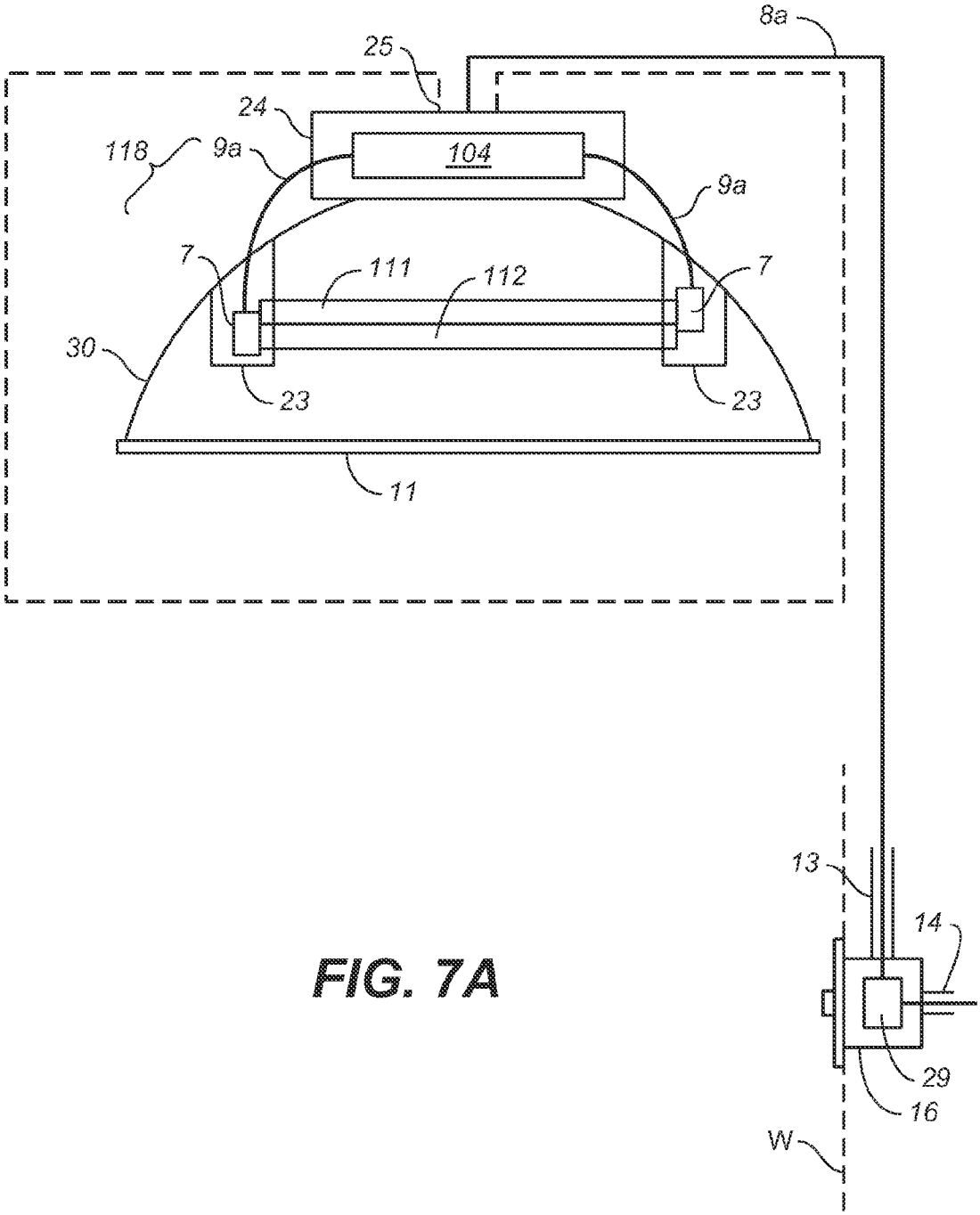
FIG. 7A is a schematic view of a lighting fixture system that may be used to replace a conventional lighting fixture, employing two CCFL devices controlled by a controller that enables adjustable color temperature or multiple color illumination to illustrate another embodiment of the invention.

FIG. 7A illustrates a lighting fixture 118 with build in CCFL devices that can offer adjustable color temperature. Lighting fixture 118 is a fixture with two CCFL devices 111 and 112 incorporated into fixture body 30 through mechanical means 23, such as two brackets. CCFL devices 111 and 112 employ phosphor with different color temperature, such as 2700K and 8000K. By controlling their brightness independently, they can produce variable color temperature between 2700K and 7000K. Housing 24 for ballast 104 is attached to the fixture 118 and provides the mechanical connection of the lighting fixture to the ceiling through screws or rivets or eyelets 25 (not shown in detail). The ballast 104 is capable of converting power from a power source, such as a utility power line, to at least two independent AC power with voltages in the range of about 5-400 volts and varying at a frequency in the range of about 1 kc-100 kc. Ballast 104 is connected to two CCFLs 111 and 112 through separate wires in cable 9*a* and circuitry 7 as described in FIG. 3C, so that different (or the same) voltages may be applied to CCFLs 111 and 112 by ballast 104. Circuit 7 comprises a capacitor and a transformer (and optionally an inductor) capable of converting AC power having a voltage in the range of about 5 to 400 volts at a frequency in the range of about 1 to 100 kilohertz to an output power suitable for powering a CCFL. Junction box 16 houses the ON/OFF switch that controls power to lighting fixture 118. A controller 29 replaces the conventional ON/OFF switch in junction box 16 to send regular AC power from utility to lighting fixture 118 and is capable of sending also an embedded control signal through the same utility wires 8*a* to ballast 104 causing it to perform ON, OFF, or independent dimming of the two CCFL devices. Controller 29 can provide regular AC power from utility, as well as embedded control signal to multiple lighting fixtures 118 through the conventional wiring system designed for use with incandescent or HCFL. Controller 29 has an interface 29*a* which may be a control knob to perform ON/OFF/dimming manually through controller 29. Controller 29 can also be equipped with wireless means to provide ON/OFF/dimming operation (e.g. via IR or RF signals) to ballast 104 wirelessly (not shown in detail). Yet another alternative is to use extra wires (not shown), similar to wires 7*a* of FIG. 1A, to carry control signals. By replacing a conventional lighting fixture with lighting fixture 118 with CCFL devices 111 and 112, and replacing the conventional ON/OFF switch or controller by controller 29, the conventional lighting circuit is thus changed into one that can perform adjustable color temperature.

Figure 7B:
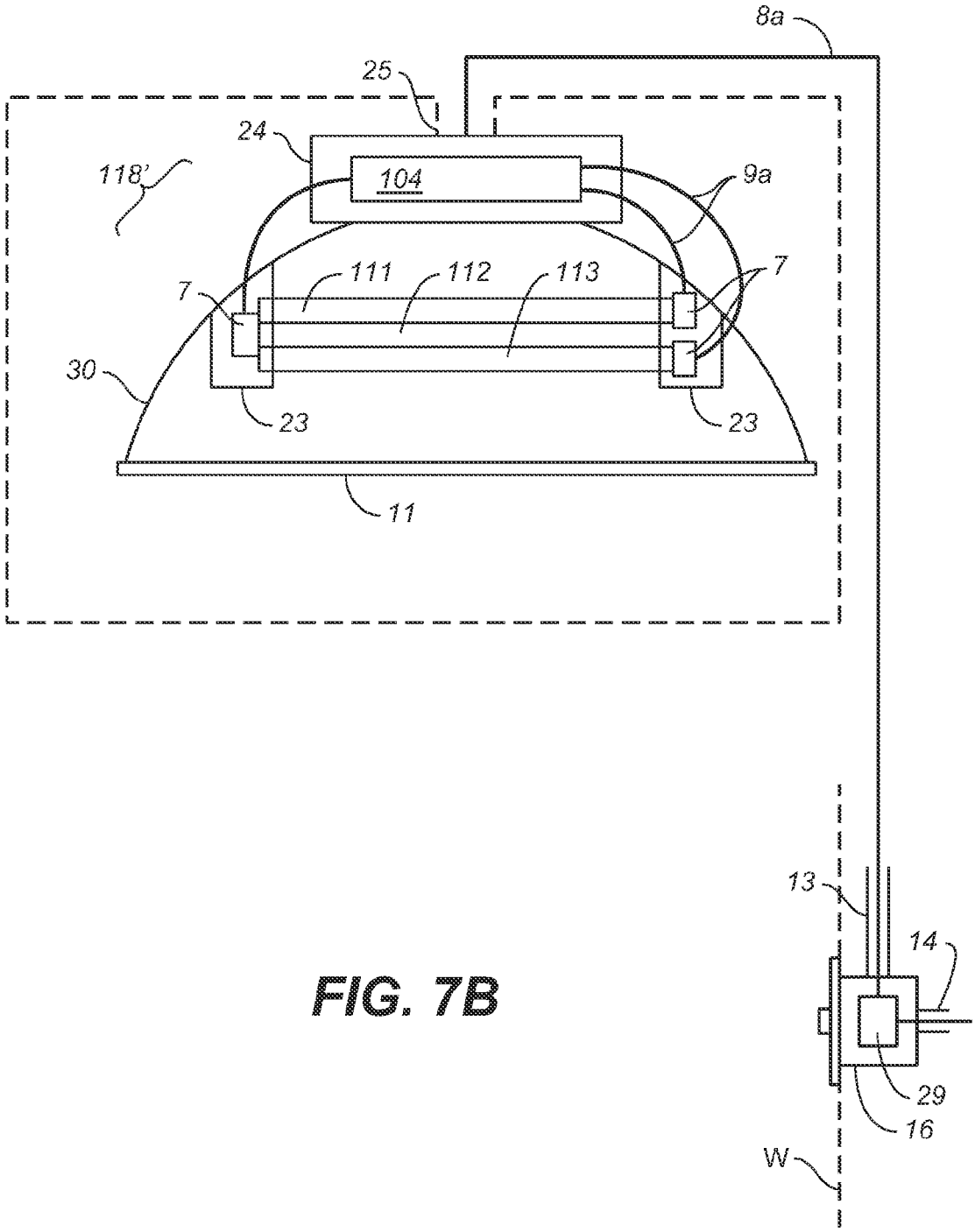
FIG. 7B is a schematic view of a lighting system that may be used to replace a conventional lighting fixture, employing three CCFL devices controlled by a controller that enables adjustable color temperature or multiple color illumination to illustrate one more embodiment of the invention.

FIG. 7B illustrates a lighting fixture 118' similar to lighting fixture 118 of FIG. 7A. Lighting fixture 118' uses three CCFLs 111, 112 and 113 instead of two CCFLs 111 and 112 as described in FIG. 7A. CCFL 111, 112 and 113 employ red, green and blue phosphors respectively. The ballast 104 can deliver three independently controlled AC powers having a voltage in the range of about 5-400 volts varying at a frequency in the range of about 1 kc-100 kc through separate wires to the three CCFLs 111, 112 and 113 through circuitry 7 as described in FIG. 3C. The ballast 104 can control the CCFL 111, 112 and 113 to operate in various brightness levels and together they will be able to provide multiple colors within lighting fixture 118. Again, controller 29 can also be equipped with wireless means in a manner similar to those described above to provide ON/OFF/various color function to ballast 104 wirelessly (not shown in detail). Thus by replacing a conventional lighting fixture with lighting fixture 118 with CCFL device 111, 112 and 113, and replacing the conventional ON/OFF switch or controller by controller 29, the conventional lighting circuit is changed into one that can perform multiple colors.

Figure 8A:
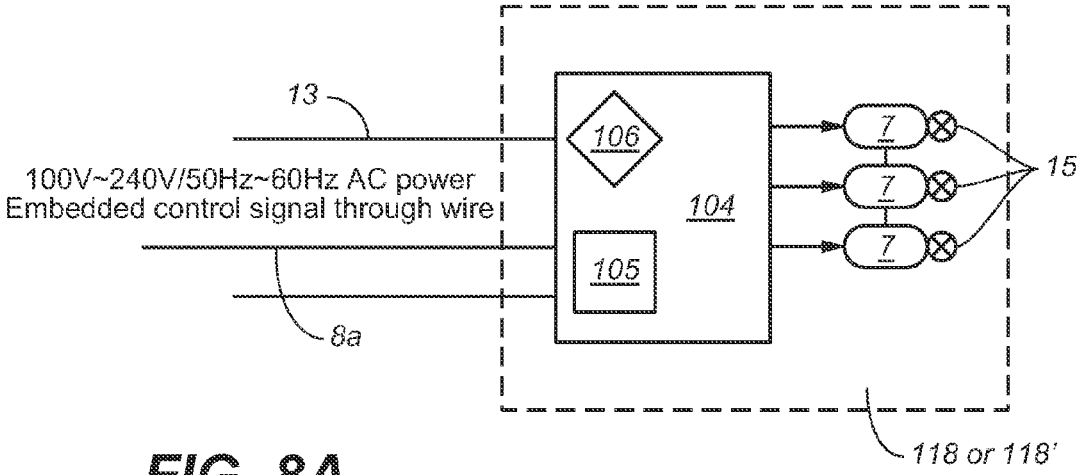
FIG. 8A is a block diagram illustrating a scheme where a lighting fixture receives power and control signals through wiring used for a conventional incandescent or HCFL lighting system to provide adjustable color temperature or multiple colors to buildings without the need to change the pre-existed lighting circuit wiring.

FIG. 8A is a block diagram that illustrates how lighting fixture 118 or 118' receives both its power and embedded control signals from the regular wiring 8*a* inside conduit 13 used for conventional incandescent and HCFL lighting system to provide adjustable color temperature or multiple colors to buildings without the need to change the pre-existed lighting circuit wiring. Ballast 104 has control signal receiver 106 which can receive embedded control signals from wires 8*a* or control signal from wireless transmitter. The embedded control signal or wireless control signal are processed by microprocessor 105 to decipher the control information therein to perform a wide variety of functions. These functions include turning lighting ON, OFF, dimming, or changing the relative intensities of light emitted by the two or three CCFL devices 15 to provide adjustable color temperature or multiple colors for lighting fixture 118 or 118'. The microprocessor 105 controls the voltages applied to the CCFL devices 15 through circuitry 7. By simply replacing the conventional lighting fixtures for incandescent or HCFL, with lighting fixture 118 or 118' with built in CCFL devices and ballast 104, it can change the conventional lighting system into one that can provide either adjustable color temperature, or multiple colors for the chamber in a building. The microprocessor 105 and signal receiver 106 may be constructed and operated according to the specifications of the X-10 Communications Protocol and Power Line Interface PSC04 & PSC05 or other industry standard protocols for transmitting embedded control signal through regular utility AC wires. Other standards may also be used. Controllers 19, 103*a* and 29 may include transmitters that transmit signals using this or other standards.

Figure 8B:
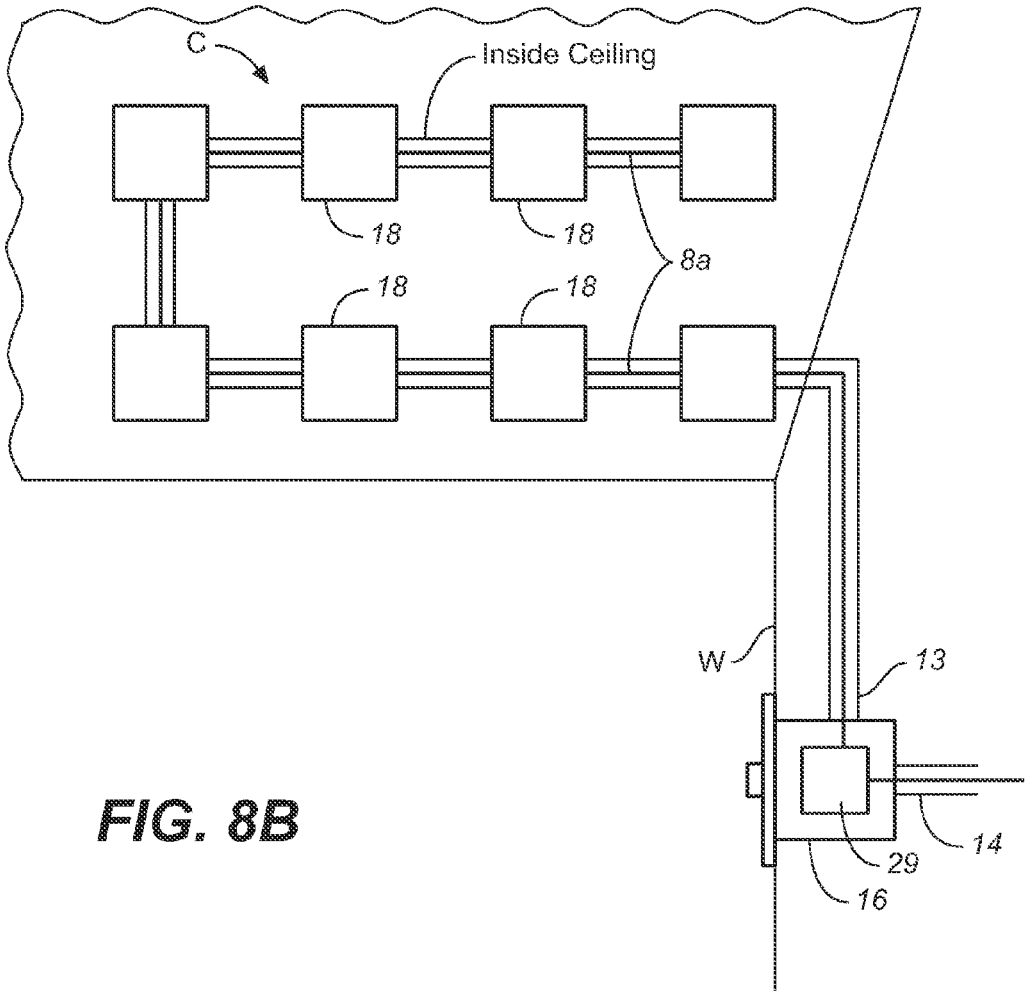
FIG. 8B is a schematic view of a lighting system employing a plurality of CCFL devices controlled by a common controller to illustrate another embodiment of the invention.

FIG. 8B illustrates how to convert a conventional lighting circuit with 8 incandescent, or HCFL lighting fixture into a new lighting circuit with 8 lighting fixtures 118. Simply replace the conventional lighting fixture with lighting fixture 118 and replace the conventional ON/OFF switch from junction box 16 by controller 29 will result in a new lighting system that can perform either adjustable color temperature, or multiple colors in any chamber in a building. There is no need to alter any pre-existed wiring in the building. Controller 29 may send embedded control signals through the power lines 8*a* or wireless signals to the drivers or ballasts 104 in fixtures 118 or 118' for driving the CCFL devices 118 or 118'.

While the invention has been described above by reference to various embodiments, it will be understood that changes and modifications may be made without departing from the scope of the invention, which is to be defined only by the appended claims and their equivalents.

What is claimed is:

1. A method for altering a lighting system for illuminating a chamber in a building, said chamber having and defined by a plurality of surfaces, said lighting system comprising at least one lighting fixture mounted onto one of the surfaces of the chamber in the building, said at least one lighting fixture including at least one conventional socket for a conventional lamp, said lighting system further comprising electrical lines and a controller controlling a current supplied to the at least one conventional socket through said electrical lines; said method comprising: electrically and mechanically connecting to said at least one conventional socket a CCFL device, said CCFL device comprising a CCFL, a connector that fits into said at least one conventional socket for electrically and mechanically connecting said CCFL to the socket, and a transformer suitable for converting an AC power having a voltage in the range of about 5-400 volts and a current at a frequency in the range of about 1 kc-100 kc to an output power suitable for operating the CCFL, causing the CCFL to emit light; installing a plurality of drivers in said lighting system, the plurality of drivers suitable for converting input power from a power source to said AC power; and connecting said at least one driver to the power source for converting input power from the power source to said AC power; wherein the controller is a single controller, the plurality of drivers are daisy chained together through control ports, and the single controller only send control signal to one driver to control the plurality of drivers.

2. The method of claim 1, further comprising removing said controller.

3. The method of claim 2, wherein said installing and removing include replacing said controller by a substitute controller that includes said at least one driver.

4. The method of claim 3, wherein said controller is located in a junction box behind a wall of the chamber, said substitute controller having dimensions that will fit within said junction box.

5. The method of claim 2, wherein said installing and removing include connecting said at least one driver to said electrical lines so that the at least one driver is in a circuit path between said controller and said at least one conventional socket.

6. The method of claim 5, said installing and removing comprising replacing said controller by a substitute controller, wherein said substitute controller modulates electrical power in the electrical lines to transmit embedded signals to said at least one driver to control an output of said at least one driver and a corresponding intensity of light emitted by said at least one CCFL device.

7. The method of claim 5, further comprising installing a wireless controller, wherein said wireless controller is adapted to transmit electrical signals to said at least one driver to control an output of said at least one driver and intensity of light emitted by said at least one CCFL device.

8. The method of claim 5, said installing and removing comprising replacing said controller by a substitute controller and an electrical connection between said substitute controller and said at least one driver, wherein said substitute controller transmits signals to said at least one driver through said electrical connection to control an output of said at least one driver and a corresponding intensity of light emitted by said at least one CCFL device.

9. The method of claim 5, said lighting system comprising a plurality of lighting fixtures mounted onto the surfaces of the chamber, each of said plurality of lighting fixtures including at least one conventional socket for a conventional lamp, said controller controlling a current supplied to the at least one conventional socket of each of said plurality of lighting fixtures through said electrical lines; said method further comprising: electrically and mechanically connecting to said at least one conventional socket of each of said plurality of lighting fixtures a CCFL device, said CCFL device comprising a CCFL, a connector that fits into said at least one conventional socket for electrically and mechanically connecting said CCFL to the socket, and a transformer suitable for converting an AC power having a voltage in the range of about 5-400 volts and a current at a frequency in the range of about 1 kc-100 kc to an output power suitable for operating the CCFL, causing the CCFL to emit light; so that the CCFL devices connected to the plurality of lighting fixtures are powered by said at least one driver.

10. A method for altering a lighting system for illuminating a chamber in a building, said chamber having and defined by a plurality of surfaces, said lighting system comprising at least one lighting fixture mounted onto one of the surfaces of the chamber in the building, electrical lines and a controller controlling a current supplied to the at least one lighting fixture through said electrical lines; said method comprising: (a) replacing said at least one lighting fixture by at least one substitute lighting fixture, each of said at least one substitute lighting fixture comprising: at least two CCFL devices, each of the CCFL devices comprising at least one CCFL and at least one transformer, said at least one transformer in each of the CCFL devices suitable for converting an AC power having a voltage in the range of about 5-400 volts and a current at a frequency in the range of about 1 kc-100 kc to an output power suitable for operating said at least one CCFL in such CCFL device, causing the at least one CCFL to emit light; a plurality of drivers supported by said fixture supplying voltages in the range of about 5-400 volts and currents at frequencies in the range of about 1 kc-100 kc to said at least two CCFL devices to cause said at least two CCFL devices to emit light, the plurality of drivers connected by separate electrical connections to at least two CCFL devices for supplying the same or different voltages or currents to the at least two CCFL devices, the at least two CCFL devices comprising CCFLs with phosphors of different color temperatures, to provide adjustable color temperature lighting; and a housing mechanically connected to and supporting the at least two CCFL devices and at least one driver so that the at least one driver is spaced apart from the at least two CCFL devices, and so that the at least one driver is substantially unaffected adversely by heat generated by the at least two CCFL devices, said housing suitable to be mounted onto one of the surfaces of said chamber, so that light emitted by said at least two CCFL devices illuminates said chamber; (b) connecting said electrical lines to the at least one driver; and (c) replacing the controller by a substitute controller capable of sending signals to the at least one driver to control the voltages or currents supplied to the at least two CCFL devices, to provide adjustable color temperature lighting; wherein the substitute controller is a single controller, the plurality of drivers are daisy chained together through control ports, and the single controller only send control signal to one driver to control the plurality of drivers.

11. The method of claim 10, wherein the substitute controller is capable of sending embedded signals through the electrical lines to control the at least one driver.

* * * * *